US008469772B2

(12) United States Patent
Crouch

(10) Patent No.: US 8,469,772 B2
(45) **Date of Patent: *Jun. 25, 2013**

(54) DECORATIVE COVER FOR STRAPS

(76) Inventor: Myra J. Crouch, Virginia Beach, VA (US)

( * ) Notice: Subject to any disclaimer, the term of this patent is extended or adjusted under 35 U.S.C. 154(b) by 188 days.

This patent is subject to a terminal disclaimer.

(21) Appl. No.: 12/898,101

(22) Filed: Oct. 5, 2010

(65) Prior Publication Data

US 2011/0016616 A1 Jan. 27, 2011

Related U.S. Application Data

(63) Continuation-in-part of application No. 11/982,118, filed on Nov. 1, 2007, now Pat. No. 7,833,085.

(51) Int. Cl.
*A41C 3/00* (2006.01)

(52) U.S. Cl.
USPC ..... 450/86; 2/338

(58) Field of Classification Search
USPC ..... 2/336, 338, 310–312, 244, 246, 69, 2/105, 106; 450/86, 88
See application file for complete search history.

(56) References Cited

U.S. PATENT DOCUMENTS

| | | | | |
|---|---|---|---|---|
| 3,848,270 | A | 11/1974 | Rand | |
| 4,941,237 | A | 7/1990 | Hovis | |
| 5,172,428 | A | 12/1992 | Leinoff | |
| 5,309,608 | A | 5/1994 | Lucas | |
| 5,852,829 | A | 12/1998 | Relaford | |
| 5,914,166 | A | 6/1999 | Le | |
| 7,833,085 | B2 * | 11/2010 | Crouch | 450/86 |
| 2009/0117826 | A1 | 5/2009 | Crouch | |

* cited by examiner

*Primary Examiner* — Gloria Hale
(74) *Attorney, Agent, or Firm* — Williams Mullen

(57) ABSTRACT

A decorative strap cover that is fastened to a strap on an article of clothing that may cover a portion of a bra, a dress, lingerie, shirt, tank top, halter top, pants, belt loops or belt and may provide a decorative compartment. The decorative strap cover may be worn as a single component or combined with others as desired.

6 Claims, 9 Drawing Sheets

DECORATIVE COVER FOR STRAPS

CROSS-REFERENCE TO RELATED APPLICATION

The present application is a continuation-in-part of U.S. application Ser. No. 11/982,118, titled, "Decorative Cover For Straps", filed on Nov. 1, 2007 now U.S. Pat. No. 7,833,085, which is incorporated by reference in its entirety.

STATEMENT REGARDING GOVERNMENT SUPPORT

This invention did not receive any federal research and development funding.

BACKGROUND OF THE INVENTION

1. Field of the Invention

Generally the invention relates to a cover that overlays a strap that comprises a sleeveless article of clothing such as a bra, a dress, a lingerie, a shirt, a tank top, a halter top or a pair of pants. More specifically, the present invention relates to a decorative overlay or cover that fastens to an outer surface of a strap. The decorative overlay may include patches, three-dimensional items, personalized indicia, ornaments, trinkets and the like. In instances where a bra having straps is worn underneath another article of clothing having straps, the strap cover may be disposed between the bra strap and the strap for the article of clothing.

2. Description of Related Art

Articles of clothing for women include various types of sleeveless clothes including bras, dresses, lingerie, shirts, tank tops, halter tops and pants that include straps. The phrase "article of clothing" should be interpreted broadly to include those items set forth above and including blouses, skirts, and pants. Other types of articles of clothing include those having belt loops or other straps that may engage the body of a wearer. The strap cover may be modified to fit the belt loops and other straps. The term "shoulder-less" should be interpreted broadly to include clothing that comprises support straps across the shoulder of the clothes wearer.

In modern society, it is considered unsightly for a woman to wear an article of clothing that reveals her bra strap. Thus, various types of bras are provided in the marketplace. Some of these bras include strapless versions or bras having removable straps to be worn with shoulder-less or sleeveless garments. Since many bras are costly, it may not be practical for many women to purchase a wide variety of bras. Thus, the present invention provides a cost effective alternative for women who cannot afford a strapless bra by covering their bra strap when the bra is worn with shoulder-less clothing.

Problems associated with the showing of a bra strap has been identified in the prior art. For example, in U.S. Pat. No. 5,914,166 to Le, a bra strap securing system for securing a bra strap underneath various types of sleeveless articles of clothing is disclosed. The bra-strap securing system retains the bra strap directly underneath a shirt strap to prevent the bra strap from exposure by adhering the bra strap to an underside of the shirt strap. However, Le cannot be used with articles of clothing that do not include at least a strap.

While Le fulfils it particular objective of securing a bra strap to an underside of a strap for an article of clothing, it cannot achieve the objectives of the presently set forth invention. Moreover, the Le invention cannot be used to cover a bra strap when the bra is worn with an article of clothing that does not include a strap or strip of fabric arranged over the shoulders of the wearer. In this respect, the present invention substantially departs from the prior art and in doing so provides a novel device and method for covering and decorating a strap that extends across a shoulder of a wearer or is arranged against another region of the wearer's body.

BRIEF SUMMARY OF THE INVENTION

The invention is a strap cover for preferably a sleeveless article of clothing. The length of the strap cover is substantially equal to the length of the strap upon which it will be secured. In one embodiment, the strap cover is preferably fastened to the sleeveless article of clothing via a fastener such as a strip of double sided adhesive arranged between the strap cover and strap. In another embodiment, the strap cover includes small tabs that extend from opposite sides of the strap cover to pass underneath the strap, overlap one another forming a tube-like structure and attaching to each other such that the strap cover is fastened onto and/or around the strap. The strap cover comprises a decorative material, a decorative item, or an ornamental feature overlaid and fastened onto an exterior side of the bra strap or other such strap affixed to an article of clothing. The strap covering may be used to overlay a purse strap as well.

It is also an objective of the strap cover to be made of various lengths for use to accessorize and cover items with a strap-like component such as belt loops, belts or suspenders or to act independently as a decorative sash in lieu of a belt. The strap may be attached at the ends to additional straps to attain a desired length or attached on the edge to one or more strap to widen, or provide complementary decorations.

It is also an objective to include decorative compartments for placing small items within or securing personal items, such as headset or ear bud wires.

It is also an objective to provide a strap that may attach to the fasteners of a strapless bra to provide decorative support without utilizing the original strap as in a faux strap as well as in combination with at least more than one additional strap.

It is an object of the invention to provide a strap cover that covers a strap provided on one or more selected from a group consisting of a sleeveless article of clothing such as a bra, a dress, lingerie, a shirt, a tank top, a halter top, a purse and a pair of pants.

It is another object of the invention to provide a strap cover that includes a fastening means that comprises a double sided adhesive arranged between a strap on a sleeveless article of clothing and the strap cover which comprises a decorative overlay. In this manner, a strap may be interchangeably decorated such that one strap cover may be easily removed and replaced with another one.

It is a further object of the invention to provide a strap cover that includes a fastening means that comprises a plurality of pairs tabs that extend on opposite sides of the strap cover. Each pair of tabs overlay one another on a lower side of the strap to secure the strap cover to the strap. Fastening means may comprise, hook-and-loop fasteners, snap fasteners, or double sided adhesive.

It is an additional object of the invention to provide an ornamental covering for a strap that may be easily attached to an exterior side of a strap opposite the side of the strap in contact with a wearer's body, such as a shoulder. The strap may comprise a small strip of material such as in a halter top that includes spaghetti straps or a wider strip of material such as the shoulder straps of a tank top.

It is another object of the invention to provide an ornamental covering that may cover one or more straps selected from a group consisting of spaghetti straps, bra straps and tank top straps.

It is a further objective of the invention to provide a strap of decorative cloth, including elastic materials singly or in combination with other materials.

Further objects, features and advantages of the invention will become apparent from a consideration of the following description and the included claims when taken in connection with the previous discussion and the accompanying drawings.

DETAILED DESCRIPTION OF THE INVENTION

Figure 1A:
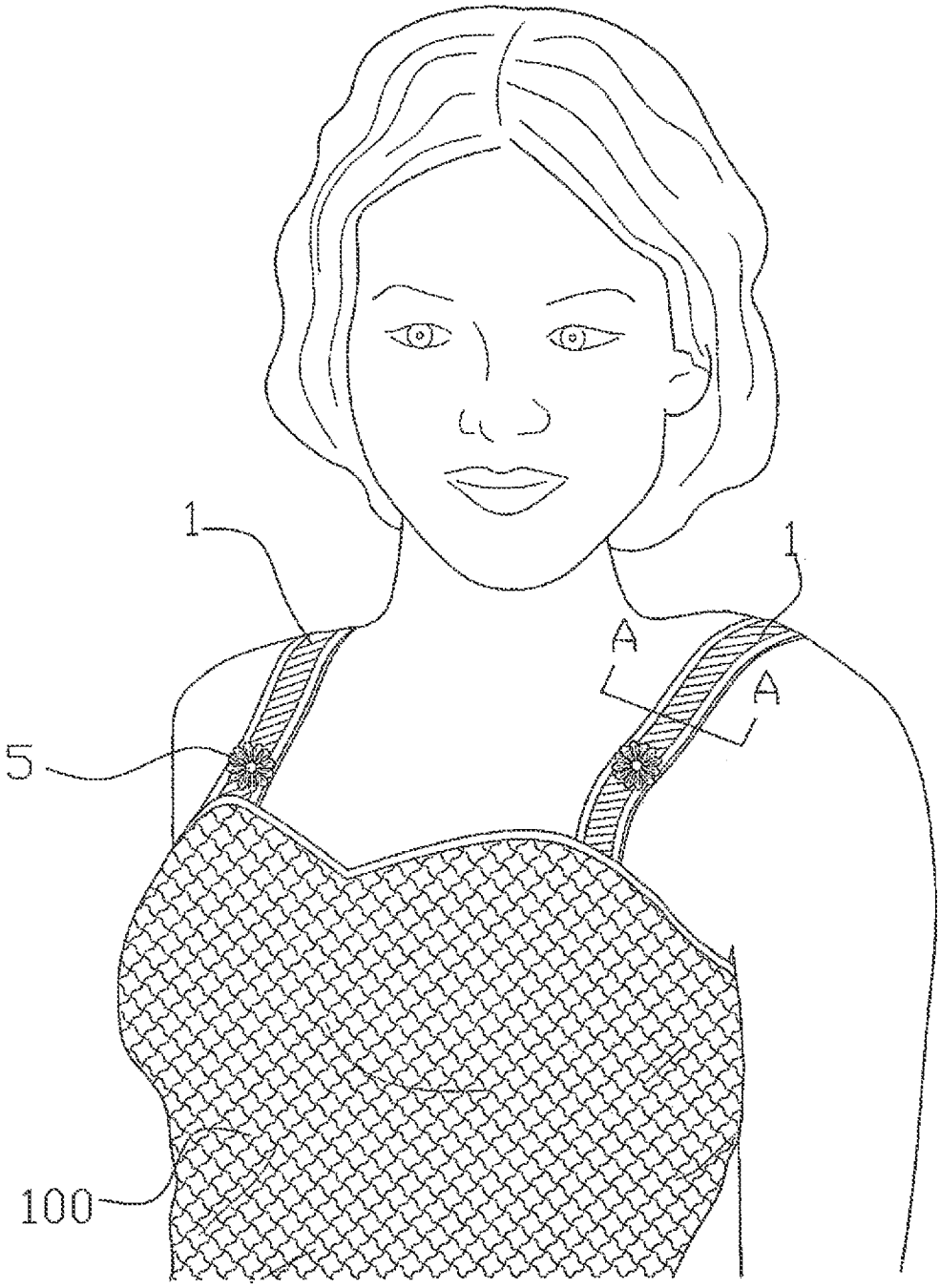
FIG. 1A is a perspective view of an ornamental strap cover that is provided on a bra strap arranged underneath a strapless, sleeveless article of clothing.

The embodiments of the invention and the various features and advantageous details thereof are more fully explained with reference to the non-limiting embodiments and examples that are described and/or illustrated in the accompanying drawings and set forth in the following description. It should be noted that the features illustrated in the drawings are not necessarily drawn to scale, and the features of one embodiment may be employed with the other embodiments as the skilled artisan recognizes, even if not explicitly stated herein. Descriptions of well-known components and techniques may be omitted to avoid obscuring the invention. The examples used herein are intended merely to facilitate an understanding of ways in which the invention may be practiced and to further enable those skilled in the art to practice the invention. Accordingly, the examples and embodiments set forth herein should not be construed as limiting the scope of the invention, which is defined by the appended claims. Although the figures are drawn to a bra strap illustration, the objective is to include such items as purse straps, belt loops, belts and other apparel accessories as described. Moreover, it is noted that like reference numerals represent similar parts throughout the several views of the drawings.

Figure 1B:
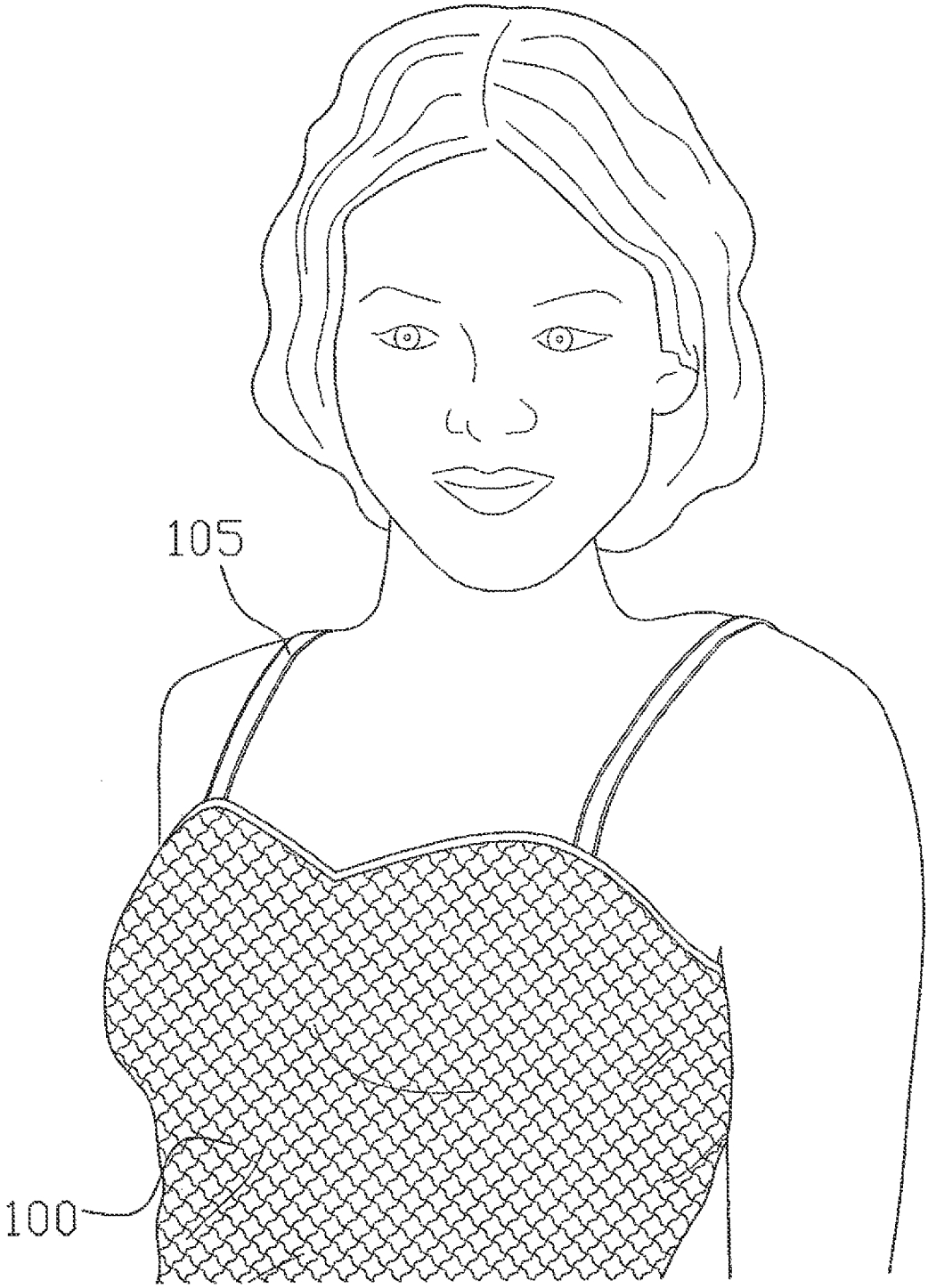
Fig. 1B Prior Art
FIG. 1B is a prior art sleeveless article of clothing shown in FIG. 1A and showing bra straps extending from beneath the article of clothing.
Figure 1C:
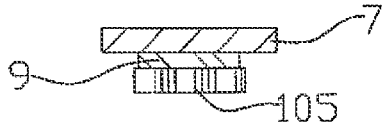
FIG. 1C is a cross section view of the strap cover taken from line A-A in FIG. 1A, and showing the fastening means, and the underlying strap.
Figure 2C:
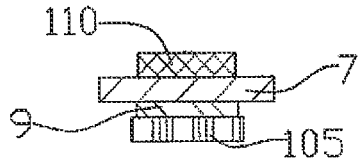
FIG. 2C is a cross section view of the strap cover taken from line B-B of FIG. 2A and showing the fastening means, the overlying strap and an underlying bra strap.
Figure 3C:
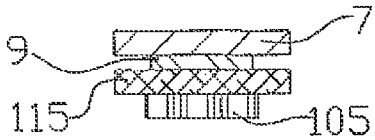
FIG. 3C is a cross section view of the strap cover taken from line C-C of FIG. 3A, and showing the fastening means, and the two underlying straps.
Figure 5A:
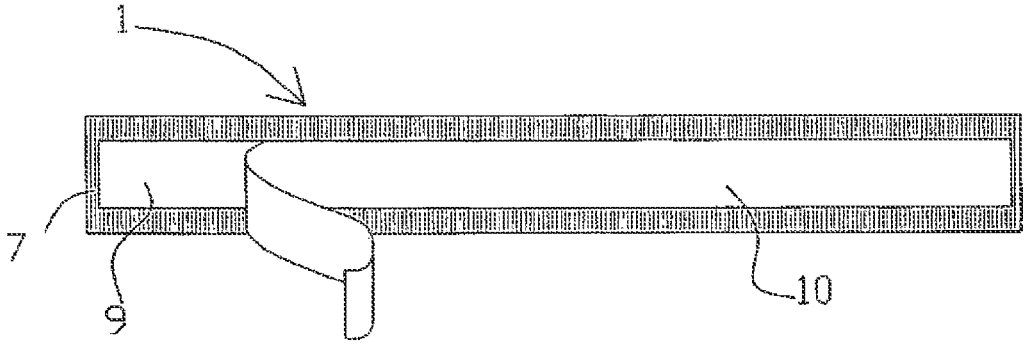
FIG. 5A is a backside view of the present invention.
Figure 5B:
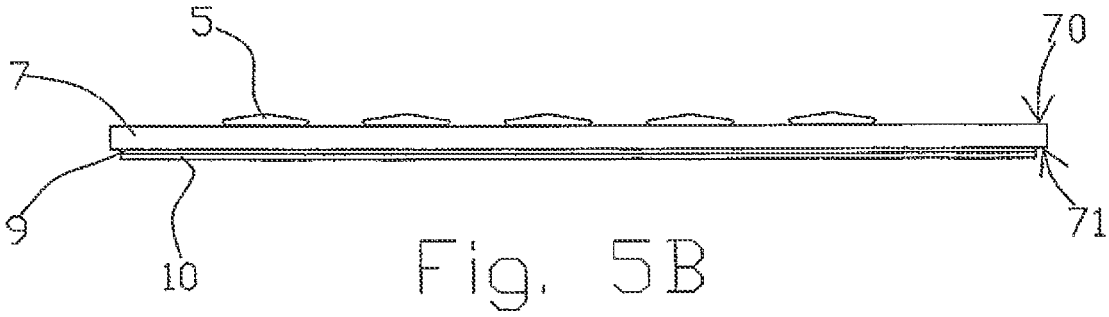
FIG. 5B is an elevated view taken from the side FIG. 5A.

FIG. 1A shows one method of wearing the strap cover 1 with a strapless, sleeveless article of clothing 100 under which a bra (not shown) is being worn. The strap cover 1 is substantially equal in length to the underlying bra strap 105. As shown in FIG. 1B, a bra strap 105 extends from beneath the article of clothing 100 and would be unsightly if worn in this manner. A strap cover 1 is affixed to each bra strap as shown in FIG. 1A. FIG. 1C is a cross section view taken from line A-A of FIG. 1A and shows the arrangement of parts of the strap cover 1. The strap cover 1 includes a strap cover material 7 that is preferably wider than the strap to which it will be attached to ensure complete coverage of the underlying strap, bra strap 105. Likewise, the length of the strap cover material 7 is substantially equal to the length of the underlying strap. In this embodiment, the fastening means 9 for fastening the strap cover material 7 to the underlying bra strap 105 comprises a strip of adhesive 9 arranged between an underside of the strap cover 71 and an upper side of the underlying strap 105, as shown in FIG. 5B. Ornaments 5 may be arranged on or fastened to an upper side 70 of the strap cover material 7, as shown in FIGS. 1A and 5A. The strap cover material 7 may comprise cloth, a woven material, elastic or any cloth-like material that includes a flexibility comparable or substantially equal to a material comprising a bra strap, a tank top strap or a spaghetti strap.

Figure 2A:
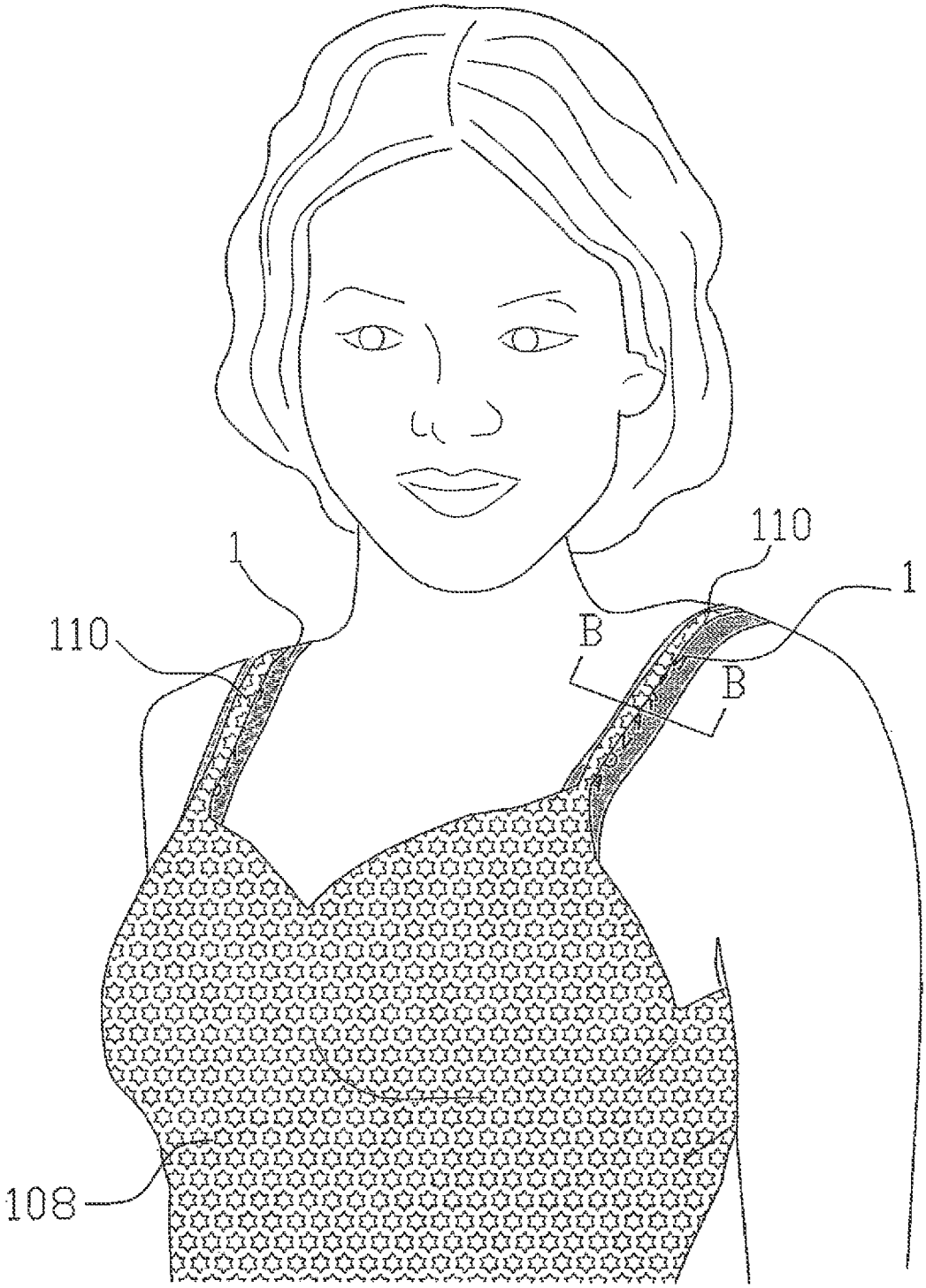
FIG. 2A is a perspective view of a decorative strap cover for a bra strap worn with an article of clothing that includes spaghetti straps.
Figure 2B:
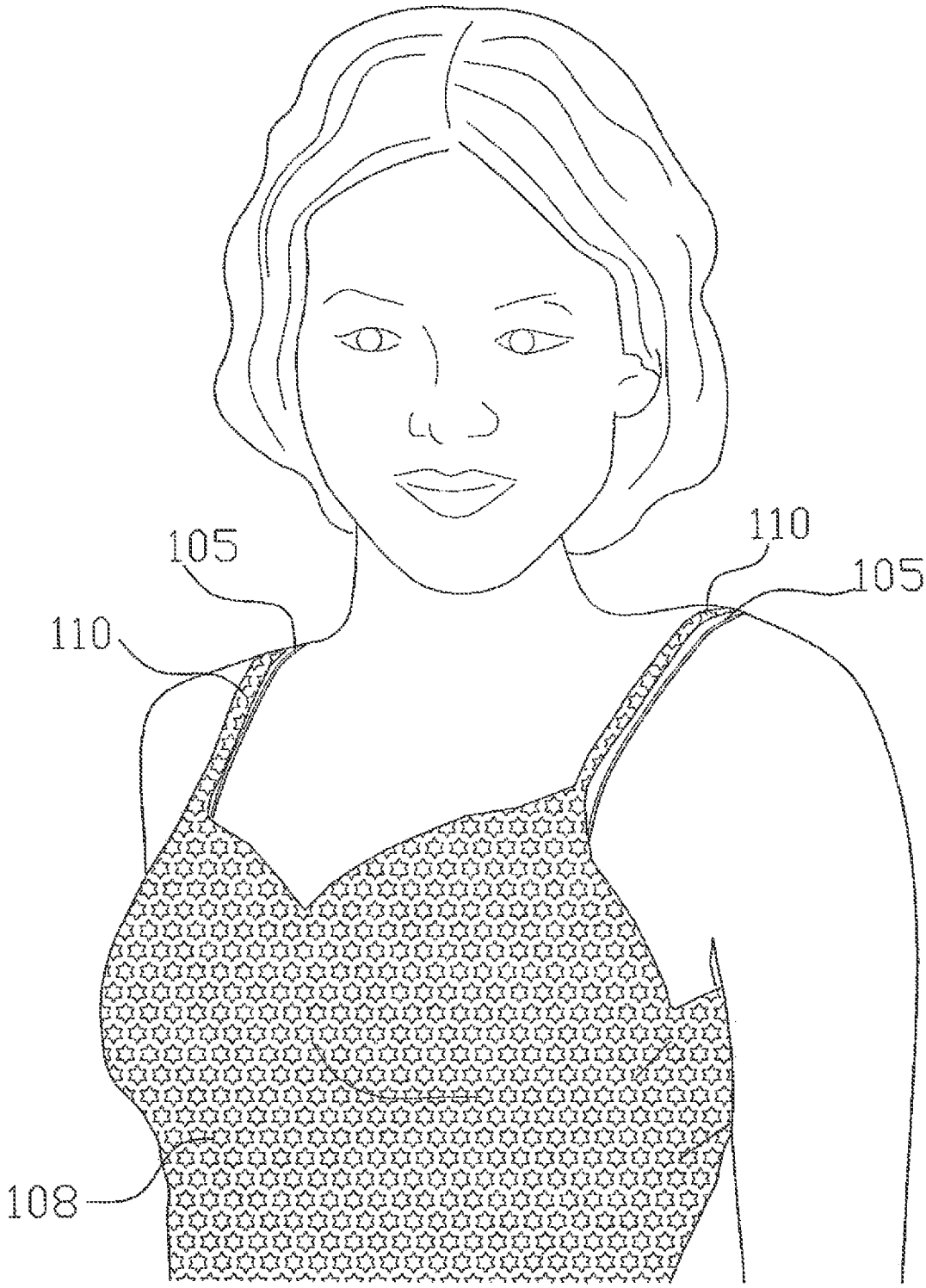
Fig. 2B Prior Art
FIG. 2B is a prior art blouse shown in FIG. 2A.

FIG. 2A shows a second method of wearing the strap cover 1 atop a bra strap 105 (shown in FIG. 2B) and beneath a sleeveless article of clothing 108 that includes spaghetti straps 110. In this instance, the strap cover 1 is arranged between the spaghetti straps 110 and the bra strap 105 (shown in FIG. 2B). As seen in FIG. 2B, the sleeveless article of clothing 108 is presents an unsightly showing of the bra strap 105. As previously discussed, material 7 is broader than bra strap 105 which is attached to the strap cover 1 via adhesive 9. Strap 1 may have at least one other strap 1 attached along the length to provide a complementary and desired appearance.

Figure 3A:
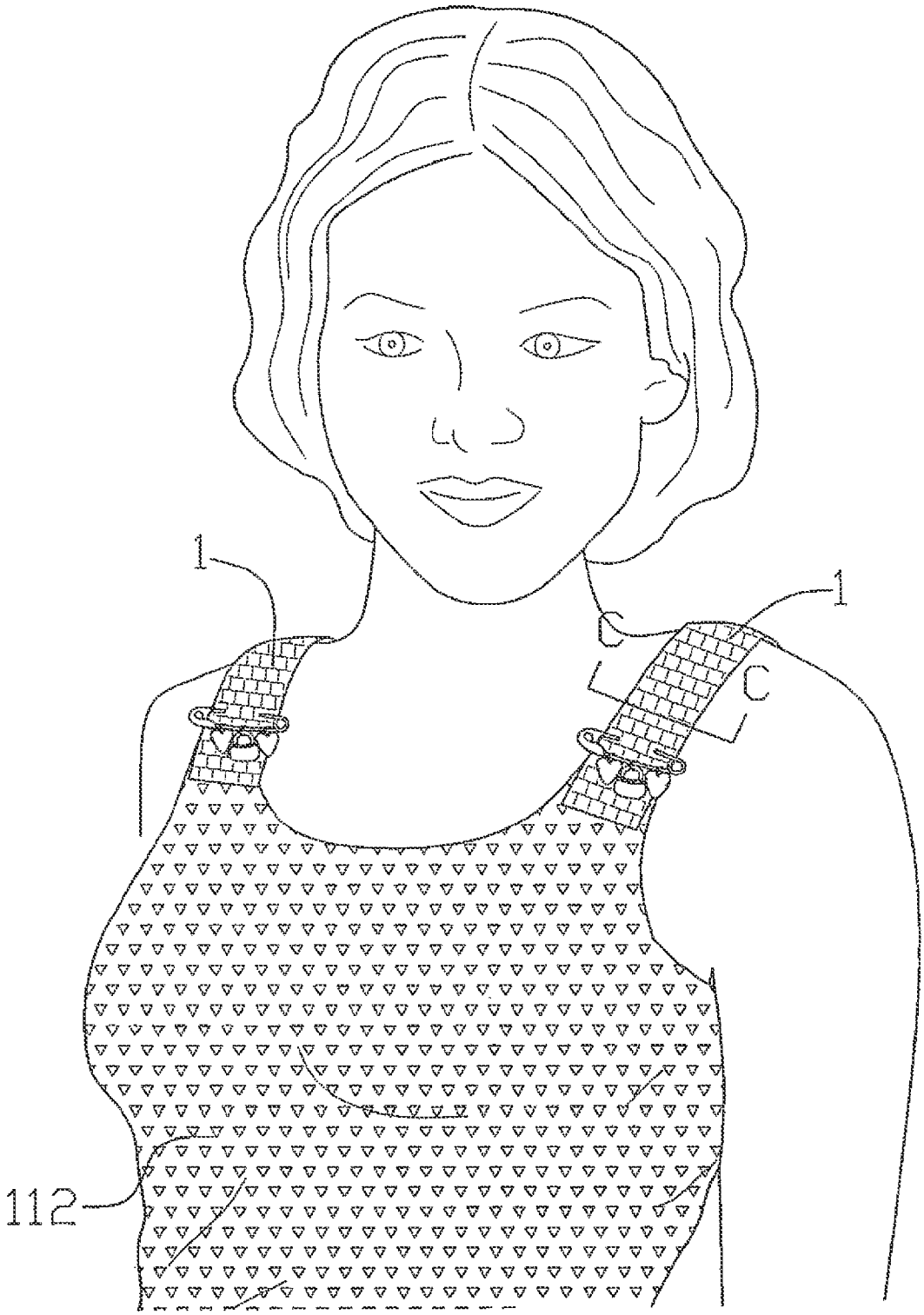
FIG. 3A is a perspective view of a decorative strap cover for a tank top strap.
Figure 3B:
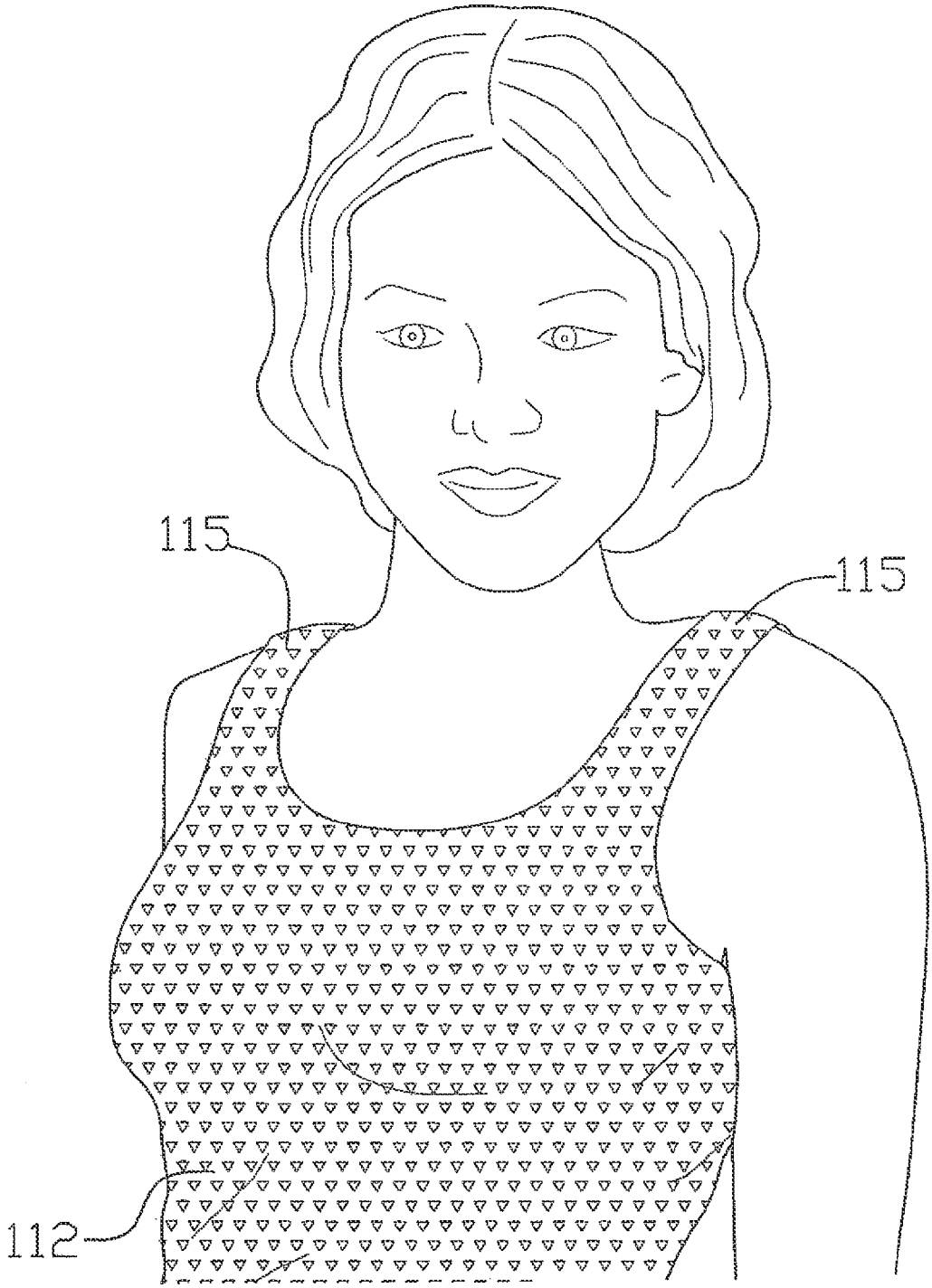
Fig. 3B Prior Art
FIG. 3B is a prior art tank top.

FIG. 3A depicts another sleeveless article of clothing, a tank top 112, that the strap cover 1 may also be worn atop. The tank top 112 includes a pair of tank top straps 115 (shown in FIG. 3B) that are wider than the spaghetti straps 110 of the sleeveless article of clothing 108. In this instance, the tank top strap 115 is arranged above the bra strap 105, the strap cover material 7 is fastened to the tank top strap 115 via adhesive 9.

Figures 4A, 4B, 4C, 4D:
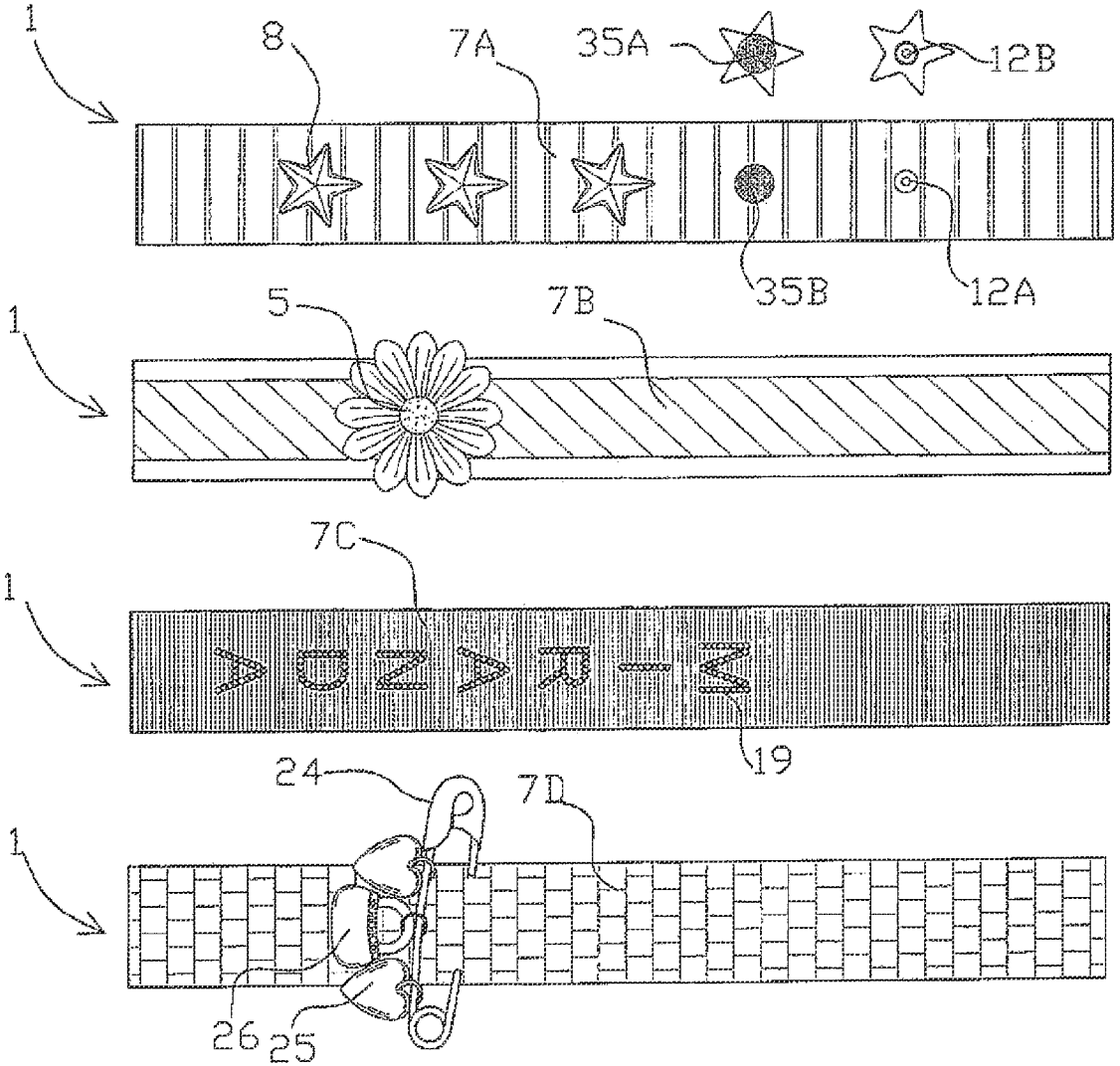
FIGS. 4A-4D depicts various decorative embodiments.

FIGS. 4A-4D shows various ornamental features that may be included in or on the strap cover 1. As shown in FIG. 4A, the strap cover 1 may comprise a strap cover material 7A that includes ornamental lines shown in the material that are perpendicular to the sides of the strap cover 1. Ornaments such as stars 8 may be adhered to or sewn on the upper side of the strap cover material 7A. Otherwise, the ornaments may be fastened onto the strap cover material 7 via hook and loop material 35A, 35B or a snap fastener, represented by elements 12A and 12B. In FIG. 4B, the strap cover material 7B is depicted as having diagonal lines in or on the material 7B and having a flower ornament 5 adhered or fastened to an upper side of the strap cover material 7B. In FIG. 4C, the material may comprise perpendicular lines and having a name or other indicia sewn or fastened to an upper side of the strap cover material 7C. In FIG. 4D, the strap cover material 7D includes a brick pattern. A safety pen 24 pierces the strap cover material 7D to secure a pair of heart ornaments 25 and a purse ornament 26 onto the strap cover 1. It should be noted that any type of material having any pattern provide thereon or therein may be used as the strap cover material 7. Likewise, any type of ornament or stitching may be included on the strap cover material in realizing the invention. In addition, strap cover 1 may be combined such as FIGS. 4A-4D drawn together edge to edge in a desired combination or combined end to end as a sash accessory.

FIG. 5A is a back side view of the strap cover 1 that comprises strap cover material 7 having an adhesive arranged on an underside 71 of the strap cover material 7. A protective overlay 10 is arranged on a side of the adhesive 9 opposite the strap cover material 7. The protective overlay 10 is removed before the strap cover 1 is secured to an underlying strap. After being laundered, the adhesive 9 may be removed and replaced with double-sided tape for use.

Figure 6A:
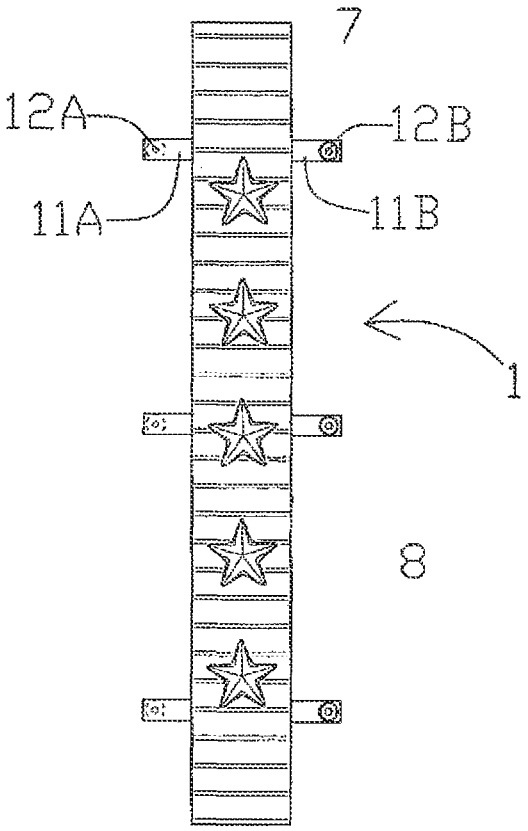
FIG. 6A is an overhead plan view of another embodiment of the invention with a fastening means comprising a snap-fastener having complementary fastening means arranged in a pair of wings along a side of the strap cover.
Figure 6B:
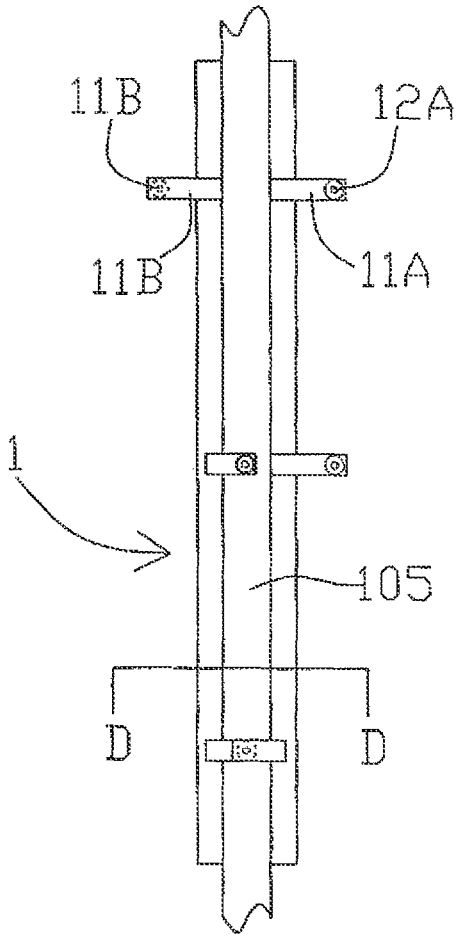
FIG. 6B is a back view showing one of the snap-fasteners encapsulating a portion of the bra strap and fastened thereto via a snap fastener arranged in the wings.
Figure 6C:
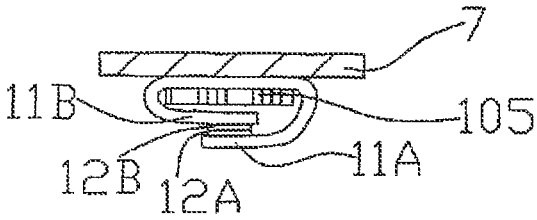
FIG. 6C is a cross section view taken from line D-D of FIG. 6A.

FIG. 6A is a further embodiment of the strap cover 1 that includes a plurality of paired wings 11A, 11B that include complementary portions of a snap fastener indicated as elements 12A, 12B. As can be understood by FIG. 6B, the paired wings 11A, 11B are stitched onto or fastened with adhesive to an underside of the strip of strap cover material 7 to wrap around the bra strap 105, or other such strap and secure the strap cover 1 thereto via a snap fastener comprising complementary portions 12A, 12B as shown in FIG. 6C. Strap cover 1 may be formed around a belt loop in a similar fashion.

It is to be understood that the invention is not limited to the exact construction illustrated and described above. Various changes and modifications may be made without departing from the spirit and the scope of the invention as defined in the following claims. While the invention has been described with respect to preferred embodiments, it is intended that all matter contained in the above description or shown in the accompanying drawings shall be interpreted as illustrative and not in limiting sense. From the above disclosure of the general principles of the present invention and the preceding detailed description, those skilled in the art will readily comprehend the various modifications to which the present invention is susceptible. Therefore, the scope of the invention should be limited only by the following claims and equivalents thereof.

What is claimed is:

1. A decorative strap cover for attachment to a bra worn by a wearer, the bra having at least one strap extending longitudinally for a strap length with a transverse strap width and a strap thickness, the strap further defining an upper side and an under side, the decorative strap cover comprising:

a flexible strap cover material having an upper face, a lower face, a cover length and a cover width, wherein the cover length is substantially equal to the strap length of the at least one strap, and wherein said strap cover width is wider than the strap width, the upper face having a substantially rectangular shape and including at least one ornamental feature; and, an attachment system for demountably attaching the strap cover to the at least one strap wherein the strap cover material substantially covers and overlies the upper side of the at least one strap, the attachment system comprising a double-sided adhesive, wherein the double-sided adhesive is configured to be fastened to the lower face of the strap cover material and to the upper side of the strap.

2. The decorative strap cover of claim 1, wherein said strap cover material is cloth, elastic, or woven material or in combination.

3. The decorative strap cover of claim 1, wherein said ornamental feature comprises an ornament removably disposed on the upper face of the strap cover material.

4. The decorative strap cover of claim 1, wherein the ornamental feature is selected from the group consisting of beads, a stitched name, and an ornamental flower.

5. The decorative strap cover of claim 3, wherein the ornament is adhered to the upper face of the strap cover material via one or more selected from the group consisting of hook-and-loop material, a snap fastener, a two-sided adhesive, stitching and a safety pin.

6. A decorative strap cover for attachment to a bra worn by a wearer, the bra having at least one strap extending longitudinally for a strap length with a transverse strap width and a strap thickness, the strap further defining an upper side and an under side, the decorative strap cover comprising:

a flexible strap cover material having an upper face, a lower face, a cover length and a cover width, wherein the cover length is substantially equal to the strap length of the at least one strap, and wherein said strap cover width is wider than the strap width, the upper face having a substantially rectangular shape and including at least one ornamental feature; and, an attachment system for demountably attaching the strap cover to the at least one strap wherein the strap cover material substantially covers and overlies the upper side of the at least one strap, the attachment system comprising:

a plurality of paired wings extending from opposite sides of the strip of strap cover material; and, a fastening device arranged on each pair of wings such that each wing wraps around the underlying strap and secures the strap cover thereto via a fastener comprising complementary portions.

* * * * *